US012370462B1

(12) United States Patent
Rao

(10) Patent No.: US 12,370,462 B1
(45) Date of Patent: Jul. 29, 2025

(54) MULTIFUNCTIONAL TOY

(71) Applicant: Zhijiao Rao, Guangdong (CN)

(72) Inventor: Zhijiao Rao, Guangdong (CN)

( * ) Notice: Subject to any disclaimer, the term of this patent is extended or adjusted under 35 U.S.C. 154(b) by 0 days.

(21) Appl. No.: 18/963,665

(22) Filed: Nov. 28, 2024

(30) Foreign Application Priority Data

Nov. 15, 2024 (CN) ..... 202422798083.5

(51) Int. Cl.
*A63H 33/42* (2006.01)
*A63H 17/44* (2006.01)
*A63H 33/26* (2006.01)

(52) U.S. Cl.
CPC ..... *A63H 33/42* (2013.01); *A63H 33/26* (2013.01)

(58) Field of Classification Search
CPC ..... A63H 31/00; A63H 33/26; A63H 33/42; A63H 17/44; A63H 3/52
USPC ..... 446/71, 423, 476, 477, 484
See application file for complete search history.

(56) References Cited

U.S. PATENT DOCUMENTS 2,050,892 A * 8/1936 Marx ..... A63H 17/44 446/423
2,188,739 A * 1/1940 Muller ..... A63H 17/44 446/190
3,735,525 A * 5/1973 Freed ..... A63H 29/24 446/435
3,797,164 A * 3/1974 Glass ..... A63H 17/008 446/397
4,087,935 A * 5/1978 Edmisson ..... A63H 17/44 446/423
4,701,150 A * 10/1987 Alvarez ..... A63H 17/44 446/431
5,797,219 A * 8/1998 Croswell ..... A63H 17/44 52/592.1
6,099,380 A * 8/2000 Rasmussen ..... A63H 18/00 446/478
6,663,464 B2 * 12/2003 Payne ..... A63H 33/28 446/16
7,059,934 B2 * 6/2006 Whitehead ..... A63H 33/042 446/484
8,062,089 B2 * 11/2011 Hardin ..... A63F 13/90 446/175
8,591,284 B2 * 11/2013 Dubois ..... A63H 3/52 446/423
8,608,529 B2 * 12/2013 Smith ..... A63H 3/52 446/476
9,452,367 B2 * 9/2016 Schmid ..... A63H 18/025
(Continued)

*Primary Examiner* — Alexander R Niconovich

(57) ABSTRACT

A multifunctional toy includes a toy main body equipped with a display window, a scene decoration device, and a scene switching device. The scene decoration device is connected to the toy main body. The scene decoration device includes a first scene decoration and a second scene decoration. The first scene decoration and the second scene decoration are movable between a first position and a second position. The scene switching device is used for driving the scene decoration device to move between the first position and the second position. When the scene switching device is in an initial state, the scene decoration device is positioned in the first position, and the first scene decoration is displayed through the display window. When the scene switching device is in a triggered state, the scene decoration device moves to the second position, and the second scene decoration is displayed through the display window.

19 Claims, 11 Drawing Sheets

(56) References Cited

U.S. PATENT DOCUMENTS

| | | | | |
|---|---|---|---|---|
| 2006/0009121 | A1* | 1/2006 | Rotundo | A63H 3/52 446/476 |
| 2008/0113586 | A1* | 5/2008 | Hardin | A63H 3/52 446/479 |
| 2024/0408508 | A1* | 12/2024 | Wu | A63H 3/52 |

* cited by examiner

MULTIFUNCTIONAL TOY

CROSS-REFERENCE TO RELATED APPLICATIONS

The application claims priority of Chinese patent application CN2024227980835, filed on Nov. 15, 2024, which is incorporated herein by reference in its entireties.

TECHNICAL FIELD

The present invention relates to the field of toys, particularly to a multifunctional toy.

BACKGROUND ART

As a type of toy that combines entertainment and intellectual development for children, toys are becoming increasingly popular among children. There are many types of toys on the market now, but most of the existing toys have few functions, simple gameplay, and lack fun, which cannot meet children's preferences.

Based on this, it is necessary to propose a new toy that not only integrates multiple different operating experiences, has strong playability and fun, but also effectively develops children's intelligence.

SUMMARY

In order to overcome the shortcomings of the prior art, a multifunctional toy is provided in the present invention. The multifunctional toy not only integrates multiple different operating experiences, has strong playability and fun, but also effectively develops children's intelligence.

The technical solution adopted by the present invention to solve its technical problem is as follows.

A multifunctional toy is provided in the present invention, including a toy main body. A display window is provided on the toy main body. The multifunctional toy includes a scene decoration device. The scene decoration device is connected to the toy main body. The scene decoration device includes a first scene decoration and a second scene decoration. The first scene decoration and the second scene decoration are movable between a first position and a second position. The multifunctional toy further includes a scene switching device. The scene switching device is used for driving the scene decoration device to move between the first position and the second position. When the scene switching device is in an initial state, the scene decoration device is positioned in the first position, and the first scene decoration is capable of being displayed through the display window. When the scene switching device is in a triggered state, the scene decoration device moves and switches to the second position, and the second scene decoration is capable of being displayed through the display window.

As an improvement of the present invention, an accommodating cavity is defined in the toy main body. When the scene switching device is in the initial state, the scene decoration device is positioned in the first position. The first scene decoration is capable of being displayed through the display window, and the second scene decoration is positioned inside the accommodating cavity. When the scene switching device is in the triggered state, the scene decoration device moves and switches to the second position, the second scene decoration is capable of being displayed through the display window, and the first scene decoration is positioned inside the accommodating cavity.

As an improvement of the present invention, the toy main body is internally equipped with a power device and a sound device. The power device, the sound device, and the scene switching device are electrically connected, so that when the first scene decoration and the second scene decoration move between the first position and the second position, the toy will emit sound.

As an improvement of the present invention, the first scene decoration includes a first connecting plate and a first decorative pattern. The second scene decoration includes a second connecting plate and a second decorative pattern. One end of the first connecting plate is connected to one end of the second connecting plate, and an opposite end of the first connecting plate extends in a different direction from an opposite end of the second connecting plate. A cavity is surrounded and formed between an inner wall surface of the first connecting plate and an inner surface of the second connecting plate. The first decorative pattern is arranged on an outer wall surface of the first connecting plate, and the second decorative pattern is arranged inside the cavity. The second decorative pattern is installed on the inner surface of the second connecting plate, and the first decorative pattern has a different appearance shape from the second decorative pattern.

As an improvement of the present invention, two side walls of the first connecting plate are respectively connected to two side walls of the second connecting plate. An engaging block is provided on a side wall of the first connecting plate, and an engaging slot is defined in a side wall of the second connecting plate. The engaging block is engaged with the engaging slot, so that the first connecting plate is connected to the second connecting plate.

As an improvement of the present invention, the toy main body includes an installation outer shell. The accommodating cavity is formed by a recess of the installation outer shell, and the scene decoration device is rotatably connected inside the installation outer shell. Rotation slots are defined in side walls at both ends of the installation outer shell. One end of the first connecting plate is provided with a connecting portion. The connecting portion includes a first connecting slot and a first connecting blocks. The first connecting blocks are positioned at two ends. A second connecting slot is defined in one end of the second connecting plate, and bottom ends of two side walls of the second connecting plate are respectively provided with second connecting blocks. The connecting portion is embedded in the second connecting slot, and the second connecting block is inserted into the rotation slot, so that the scene decoration device is rotatably connected to the installation outer shell.

As an improvement of the present invention, a first installation slot is defined in the toy main body, and the scene switching device is arranged in the first installation slot. The scene switching device includes a triggering member, and a transmission device connected to the triggering member for transmission. The transmission device is connected to the scene decoration device for transmission, so that a user can drive the transmission device by operating the triggering member, so as to move the scene decoration device between the first position and the second position.

As an improvement of the present invention, the transmission device includes a first transmission baffle. The triggering member includes an outer shell and a pressing block slidably disposed within the outer shell. A first end of the outer shell is fixedly mounted on an outer side wall of the installation outer shell, and a second end of the outer shell extends downward to form a first sliding block. The first sliding block is slidably connected to the first transmission baffle.

As an improvement of the present invention, a first connecting shaft is connected to the pressing block. The first connecting shaft is inserted into the outer shell and extends downward to connect with the first transmission baffle for transmission. A first sliding slot is defined in one side of the first transmission baffle. A position limiting member is arranged on a rear side wall of the installation outer shell. A position limiting block is arranged on the first sliding block. An engaging opening is defined in the position limiting block. The position limiting member is slidably disposed within the first sliding slot and extends outward to engage with the engaging opening, so that the first sliding block is slidably connected to the first transmission baffle.

As an improvement of the present invention, a gear portion is provided on one side of the first transmission baffle, and a second sliding slot is also defined adjacent to the gear portion. A second transmission baffle is provided on a side wall of the installation outer shell, and an opening is defined in the second transmission baffle. A transmission gear is installed in the opening. The transmission gear includes a transmission shaft, a first gear, and a second gear. The first gear and the second gear are connected to the transmission shaft. The first gear is at least partially inserted into the opening and meshes with the transmission gear. The second transmission baffle is also provided with a second sliding block. The second sliding block is slidable in the second sliding slot.

As an improvement of the present invention, one end of the second connecting plate is provided with a third gear. The third gear meshes with the second gear. When the triggering member is in a triggered state, the first connecting shaft pushes the first transmission baffle downward, the engaging opening separates from the position limiting member, the first sliding block slides downward in the first sliding slot, and the second sliding block slides downward in the second sliding slot, so that the gear portion moves downward to drive the first gear to rotate. Moreover, the first gear drives the second gear to rotate to drive the third gear to rotate, so that the scene decoration device moves and switches between the first scene decoration and the second scene decoration.

As an improvement of the present invention, the triggering member is also provided with a restoration member for restoring the pressing block. When the triggering member is in an initial state, the first connecting shaft moves upward under action of the restoration member, the first sliding block slides upward in the first sliding slot, and the second sliding block slides upward in the second sliding slot, so that the gear portion moves upward to drive the first gear, the second gear, and the third gear to rotate. Moreover, the engaging opening is engaged with the position limiting member, so that the scene decoration device switches from the second scene decoration to the first scene decoration.

As an improvement of the present invention, the toy main body includes a wall, a base, and a roof. The wall is equipped with a front side wall, a rear side wall, a left side wall, and a right side wall. The front side wall, the rear side wall, the left side wall, and the right side wall are sequentially connected to surround and form an internal accommodating space.

As an improvement of the present invention, a first door is hinged on the front side wall, and an insertion hole is defined in the base. A key for opening the first door is inserted into the insertion hole. A doorbell device is also provided on the front side wall, and a first light emitting device is provided in the doorbell device. When the first door is opened, the doorbell device and the first light emitting device are in a working state. When the first door is closed, the doorbell device and the first light emitting device are in a closed state.

As an improvement of the present invention, a second door is rotatably provided on the base. The second door and the internal accommodating space form a garage. The garage is internally equipped with a toy car. A bottom portion of the garage is equipped with an ejection plate, and the ejection plate is movably connected to an inner wall of the garage. The base is also equipped with a garage button. The garage button is used for driving the ejection plate to rotate to an ejection position, so that the toy car is ejected from the garage.

As an improvement of the present invention, the roof includes a first ceiling and a second ceiling. A first accommodating slot is defined between the first ceiling and the second ceiling. A handle is slidably provided in the first accommodating slot. The handle is capable of sliding upward or moving downward in the first accommodating slot, so that the handle has an unfolded state or a stored state. An avoidance slot is also defined in an upper edge of the first accommodating slot. The avoidance slot is used for a user to pull the handle upward out of the first accommodating slot. A second installation slot is also defined between the first ceiling and the second ceiling. A display lamp is provided in the second installation slot. The display lamp has an arc-shaped structure, and an edge of the display lamp is provided with a plurality of continuous arc-shaped blocks.

As an improvement of the present invention, telephone buttons are provided on the first ceiling. The first ceiling is provided with a second accommodating slot adjacent to the telephone button. An earpiece is provided in the second accommodating slot, and an elastic buckle is provided on a side wall of the second accommodating slot. A buckle hole is defined in a side wall of the earpiece, and the elastic buckle cooperates with the buckle hole to install the earpiece in the second accommodating slot. The second ceiling is provided with a plurality of tone buttons and a plurality of music playing buttons. The telephone button, the tone button, and the music playing button are all electrically connected to the sound device to enable the toy to emit sound.

As an improvement of the present invention, a groove is defined in the left side wall. The groove is provided with a first cross bar and a second cross bar positioned below the first cross bar. A plurality of pattern blocks are rotatably provided on the first cross bar, and a plurality of calculation beads are also rotatably provided on the second cross bar.

As an improvement of the present invention, a plurality of first installation holes are defined in the right side wall. The plurality of first installation holes have different shapes and structures. A letter button is correspondingly arranged in the first installation hole, and a light device is arranged in the letter button. When the letter button is pressed, the letter button is capable of emitting light. The sound device is provided with a first mode and a second mode. The letter button is used for switching the sound device between the first mode and the second mode. When the letter button switches the sound device to the first mode, the sound device emits a pronunciation of a letter. When the letter button switches the sound device to the second mode, the sound device emits a pronunciation of a shape.

As an improvement of the present invention, a second installation hole is defined in the rear side wall, and a clock device is installed in the second installation hole. The clock device includes a second connecting shaft, an hour hand, and a minute hand. The hour hand and the minute hand are connected to the second connecting shaft. The second connecting shaft is also provided with a fourth gear and a fifth gear. At least two elastic sheets are provided on an inner wall surface of the rear side wall, and the elastic sheets respectively abut against the fourth gear and the fifth gear, so that the hour hand and the minute hand produce damping sound when rotating.

Beneficial effects of the present invention are as follows. The multifunctional toy is provided in the present invention. The multifunctional toy includes the toy main body. The display window is provided on the toy main body. The multifunctional toy includes the scene decoration device. The scene decoration device is connected to the toy main body. The scene decoration device includes the first scene decoration and the second scene decoration. The first scene decoration and the second scene decoration are movable between the first position and the second position. The multifunctional toy further includes the scene switching device. The scene switching device is used for driving the scene decoration device to move between the first position and the second position. When the scene switching device is in the initial state, the scene decoration device is positioned in the first position, and the first scene decoration is capable of being displayed through the display window. When the scene switching device is in the triggered state, the scene decoration device moves and switches to the second position, and the second scene decoration is capable of being displayed through the display window. The multifunctional toy in the present invention uses the scene switching device to achieve the switching of the first scene decoration and the second scene decoration between the first position and the second position, allowing children to see different scene changes while playing, increasing the interactivity and fun of the toy. By changing the scene, children can learn and understand more things and environments while playing, increasing the educational value of the toy. This design not only allows children to acquire knowledge through play, but also cultivates their observational and cognitive abilities.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

Figure 1:
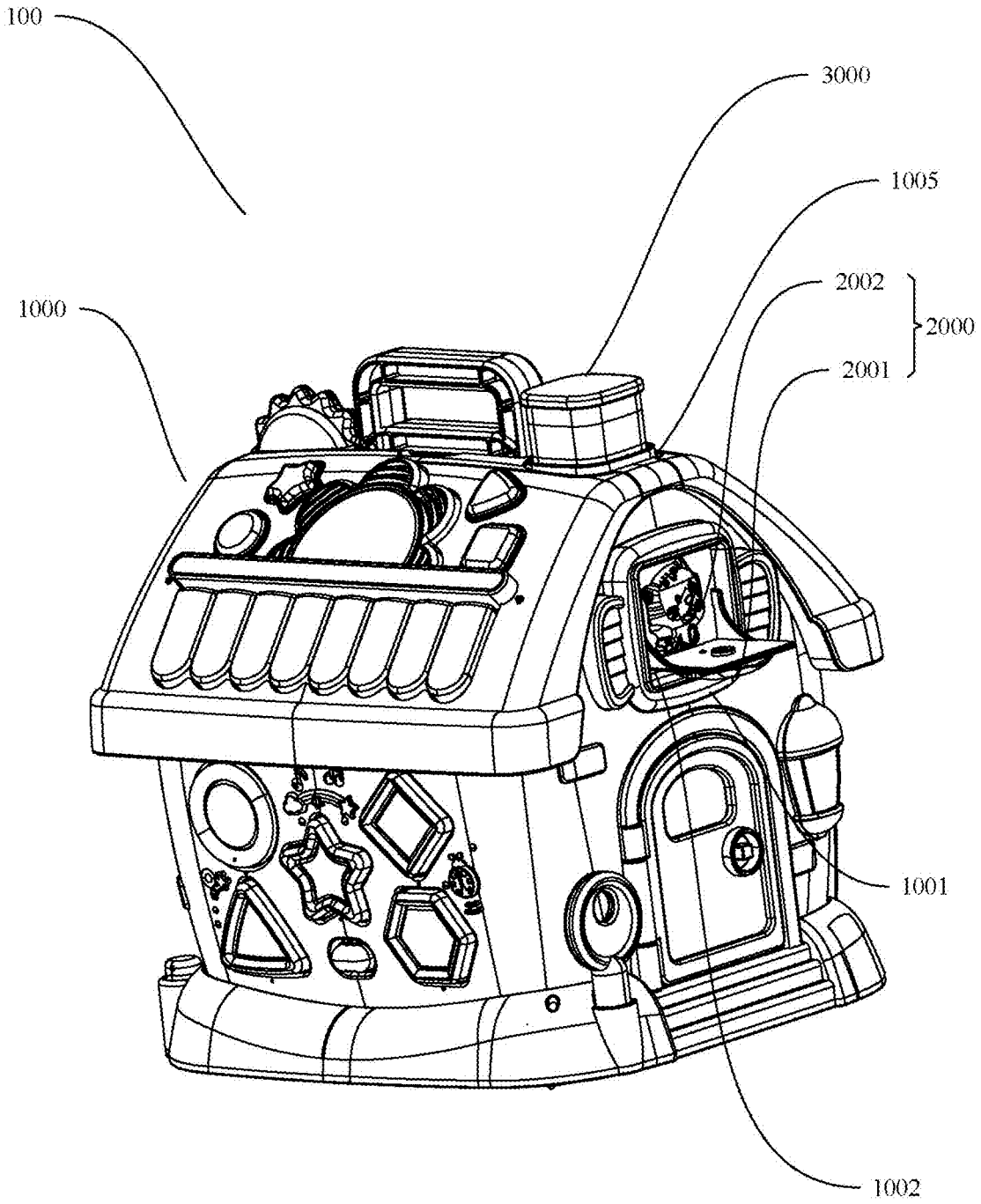
FIG. 1 is a schematic diagram of a structure in which a scene decoration device of a multifunctional toy is positioned in a first position.

REFERENCE NUMERALS toy 100; toy main body 1000; display window 1001; accommodating cavity 1002; installation outer shell 1003; rotation slot 1004; first installation slot 1005; position limiting member 1006; second transmission baffle 1101; opening 1102; transmission gear 1103; transmission shaft 1104; first gear 1105; second gear 1106; second sliding block 1107;

wall 1007; base 1008; roof 1009; front side wall 1201; rear side wall 1202; left side wall 1203; right side wall 1204; first door 1301; insertion hole 1302; key 1303; doorbell device 1304; second door 1401; garage 1402; toy car 1403; ejection plate 1404; garage button 1405; first ceiling 1501; second ceiling 1502; first accommodating slot 1503; handle 1504; avoidance slot 1505; second installation slot 1506; display lamp 1507; arc-shaped block 1508; telephone button 1601; second accommodating slot 1602; earpiece 1603; elastic buckle 1604; buckle hole 1605; tone button 1606; music playing button 1607; groove 1701; first cross bar 1702; second cross bar 1703; pattern block 1704; calculation bead 1705; first installation hole 1801; letter button 1802; second installation hole 1901; clock device 1902; second connecting shaft 1903; hour hand 1904; minute hand 1905; fourth gear 1906; fifth gear 1907; elastic sheet 1908;

scene decoration device 2000; first scene decoration 2001; second scene decoration 2002; first connecting plate 2101; first decorative pattern 2102; connecting portion 2103; first connecting slot 2104; first connecting block 2105; engaging block 2107; second connecting plate 2201; second decorative pattern 2202; second connecting slot 2203; second connecting block 2204; engaging slot 2206; third gear 2207; cavity 2301;

scene switching device 3000; triggering member 3001; transmission device 3002; first transmission baffle 3101; first sliding slot 3102; gear portion 3103; second sliding slot 3104; outer shell 3201; pressing block 3202; first sliding block 3203; first connecting shaft 3204; position limiting block 3205; engaging opening 3206; restoration member 3207.

DETAILED DESCRIPTION OF THE EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
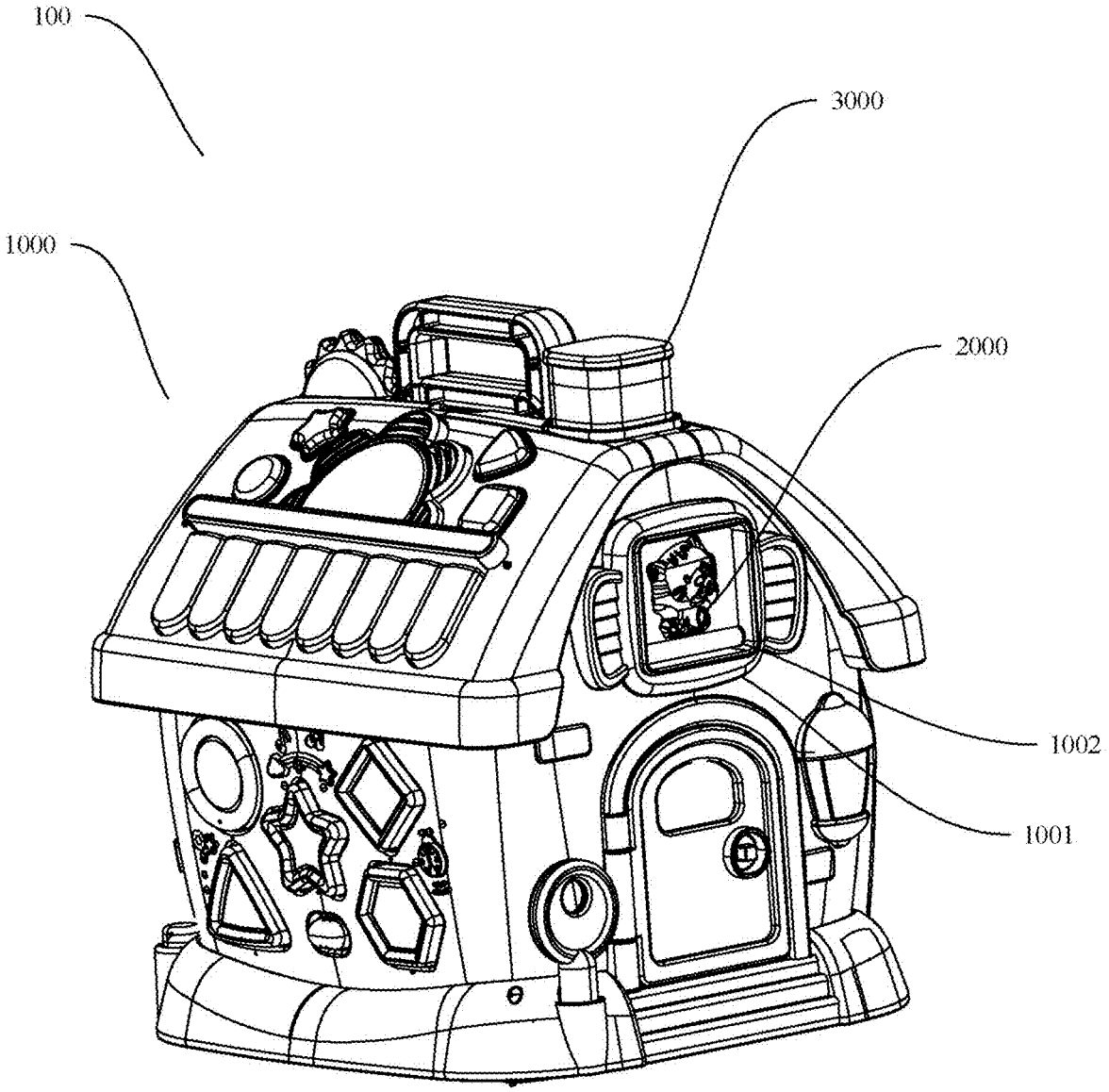
FIG. 2 is a schematic diagram of a structure in which a scene decoration device of a multifunctional toy is positioned in a second position.

A multifunctional toy 100 disclosed in the present invention, as shown in FIGS. 1-2, includes a toy main body 1000. A display window 1001 is provided on the toy main body 1000. The multifunctional toy 100 includes a scene decoration device 2000. The scene decoration device 2000 is connected to the toy main body 1000. The scene decoration device 2000 includes a first scene decoration 2001 and a second scene decoration 2002. The first scene decoration 2001 and the second scene decoration 2002 are movable between a first position and a second position. The multifunctional toy 100 further includes a scene switching device 3000. The scene switching device 3000 is used for driving the scene decoration device 2000 to move between the first position and the second position. When the scene switching device 3000 is in an initial state, the scene decoration device 2000 is positioned in the first position, and the first scene decoration 2001 is capable of being displayed through the display window 1001. When the scene switching device 3000 is in a triggered state, the scene decoration device 2000 moves and switches to the second position, and the second scene decoration 2002 is capable of being displayed through the display window 1001. The multifunctional toy 100 uses the scene switching device 3000 to achieve the switching of the first scene decoration 2001 and the second scene decoration 2002 between the first position and the second position, allowing children to see different scene changes while playing, increasing the interactivity and fun of the toy. By changing the scene, children can learn and understand more things and environments while playing, increasing the educational value of the toy. This design not only allows children to acquire knowledge through play, but also cultivates their observational and cognitive abilities.

Specifically, an accommodating cavity 1002 is defined in the toy main body 1000. When the scene switching device 3000 is in the initial state, the scene decoration device 2000 is positioned in the first position. The first scene decoration 2001 is capable of being displayed through the display window 1001, and the second scene decoration 2002 is positioned inside the accommodating cavity 1002. When the scene switching device 3000 is in the triggered state, the scene decoration device 2000 moves and switches to the second position, the second scene decoration 2002 is capable of being displayed through the display window 1001, and the first scene decoration 2001 is positioned inside the accommodating cavity 1002.

In this embodiment, the toy main body 1000 is internally equipped with a power device and a sound device. The power device and the sound device are electrically connected, and the sound device is electrically connected to the scene switching device 3000, so that when the first scene decoration 2001 and the second scene decoration 2002 move between the first position and the second position, the toy 100 will emit sound. The sound device emits sound during scene switching, providing auditory stimulation for children and combining visual and tactile experiences to form a comprehensive multi-sensory experience. This multi-sensory stimulation helps improve children's cognitive ability and attention.

Figure 3:
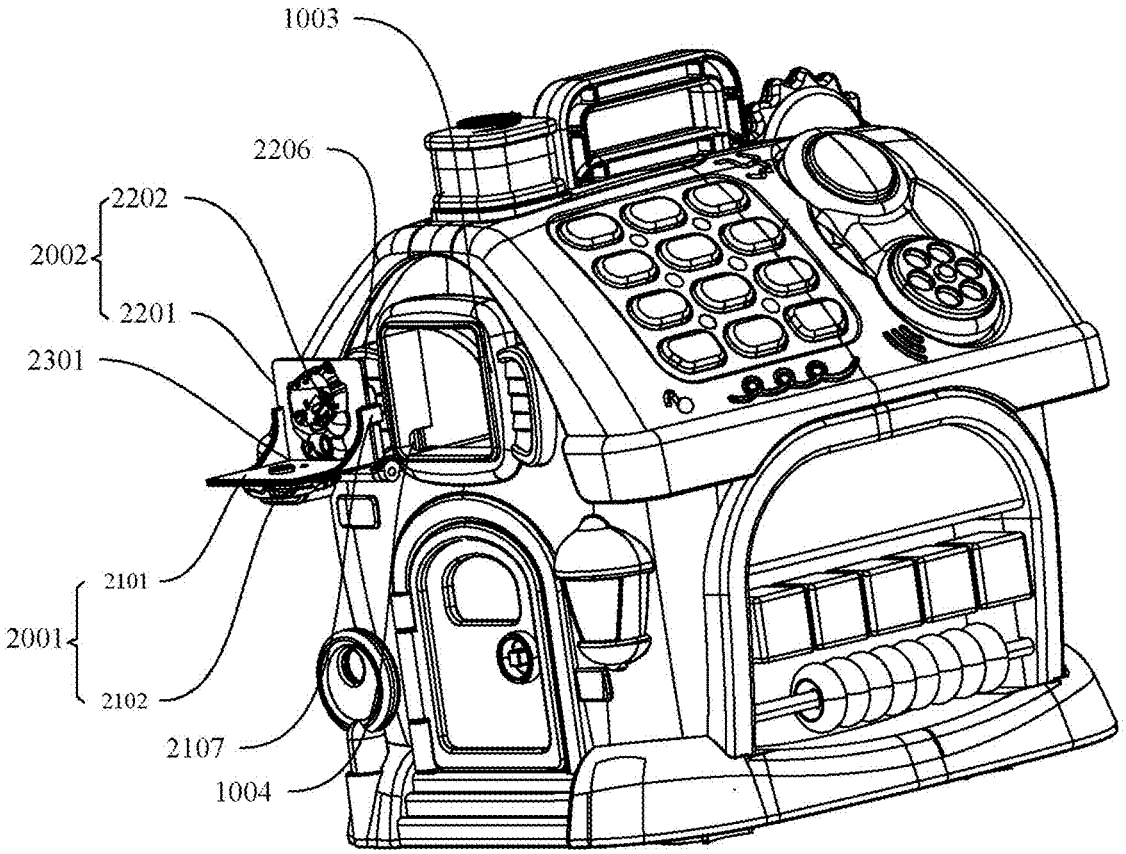
FIG. 3 is a schematic diagram of a connection structure of a scene decoration device and a toy main body.
Figure 4:
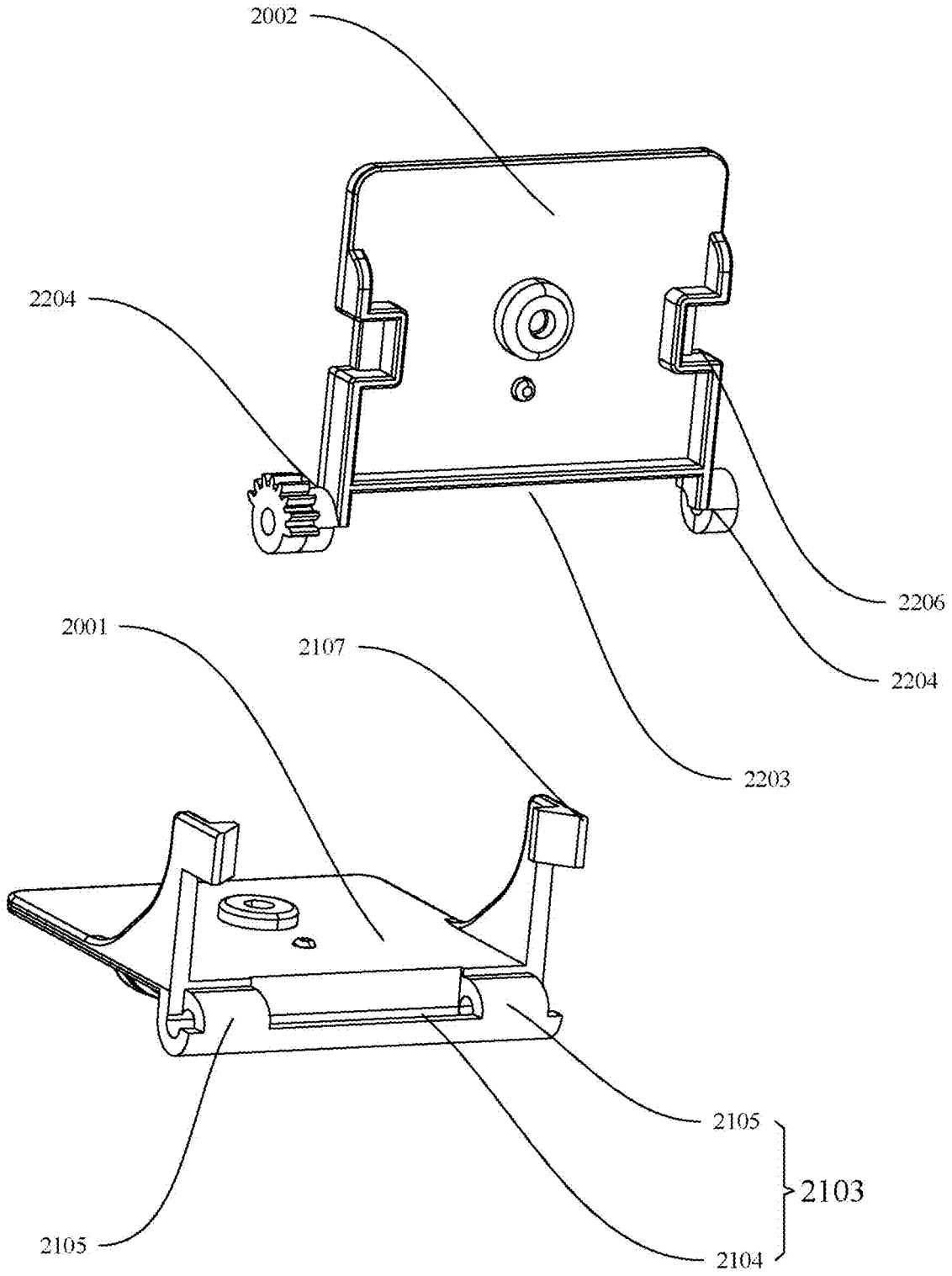
FIG. 4 is a schematic diagram of an exploded connection structure of a first scene decoration and a second scene decoration.

In this embodiment, referring to FIGS. 3-4, the first scene decoration 2001 includes a first connecting plate 2101 and a first decorative pattern 2102. The second scene decoration 2002 includes a second connecting plate 2201 and a second decorative pattern 2202. One end of the first connecting plate 2101 is connected to one end of the second connecting plate 2201, and an opposite end of the first connecting plate 2101 extends in a different direction from an opposite end of the second connecting plate 2201. A cavity 2301 is surrounded and formed between an inner wall surface of the first connecting plate 2101 and an inner surface of the second connecting plate 2201. The first decorative pattern 2102 is arranged on an outer wall surface of the first connecting plate 2101, and the second decorative pattern 2202 is arranged inside the cavity 2301. The second decorative pattern 2202 is installed on the inner surface of the second connecting plate 2201, and the first decorative pattern 2102 has a different appearance shape from the second decorative pattern 2202. The two decorative patterns have different appearance shapes, providing diverse visual effects and increasing the attractiveness and fun of the toy.

In this embodiment, two side walls of the first connecting plate 2101 are respectively connected to two side walls of the second connecting plate 2201. An engaging block 2107 is provided on a side wall of the first connecting plate 2101, and an engaging slot 2206 is defined in a side wall of the second connecting plate 2201. The engaging block 2107 is engaged with the engaging slot 2206, so that the first connecting plate 2101 is connected to the second connecting plate 2201. The engaging block 2107 is engaged with the engaging slot 2206, so that the first connecting plate 2101 and the second connecting plate 2201 are firmly connected, reducing the risk of loosening and falling off of connecting parts.

In this embodiment, the toy main body 1000 includes an installation outer shell 1003. The accommodating cavity 1002 is formed by a recess of the installation outer shell 1003, and the scene decoration device 2000 is rotatably connected inside the installation outer shell 1003. Rotation slots 1004 are defined in two side walls of the installation outer shell 1003 respectively. One end of the first connecting plate 2101 is provided with a connecting portion 2103. The connecting portion 2103 includes a first connecting slot 2104 and first connecting blocks 2105. The first connecting blocks 2105 are positioned at two ends. A second connecting slot 2203 is defined in one end of the second connecting plate 2201, and bottom ends of two side walls of the second connecting plate 2201 are respectively provided with second connecting blocks 2204. The connecting portion 2103 is embedded in the second connecting slot 2203, and the second connecting block 2204 is inserted into the rotation slot 1004, so that the scene decoration device 2000 is rotatably connected to the installation outer shell 1003. The scene decoration device 2000 is rotatably connected inside the installation outer shell 1003, achieving the rotatable switching of the scene decoration device 2000. The interactivity of the switching of the scene decoration device is increased, and children's gaming experience is enhanced.

Figure 5:
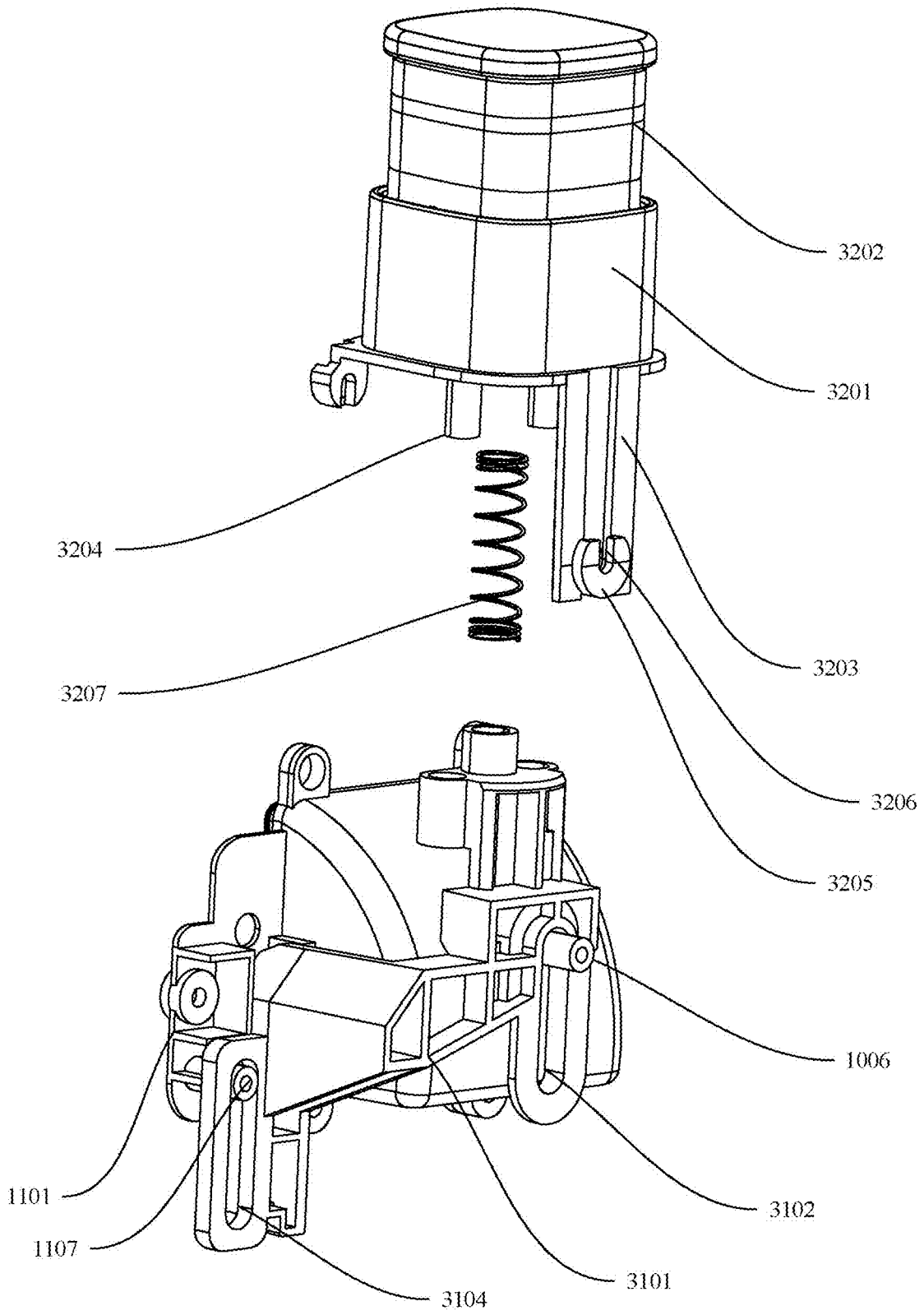
FIG. 5 is a schematic diagram of an exploded structure of a triggering member and a transmission device.
Figure 6:
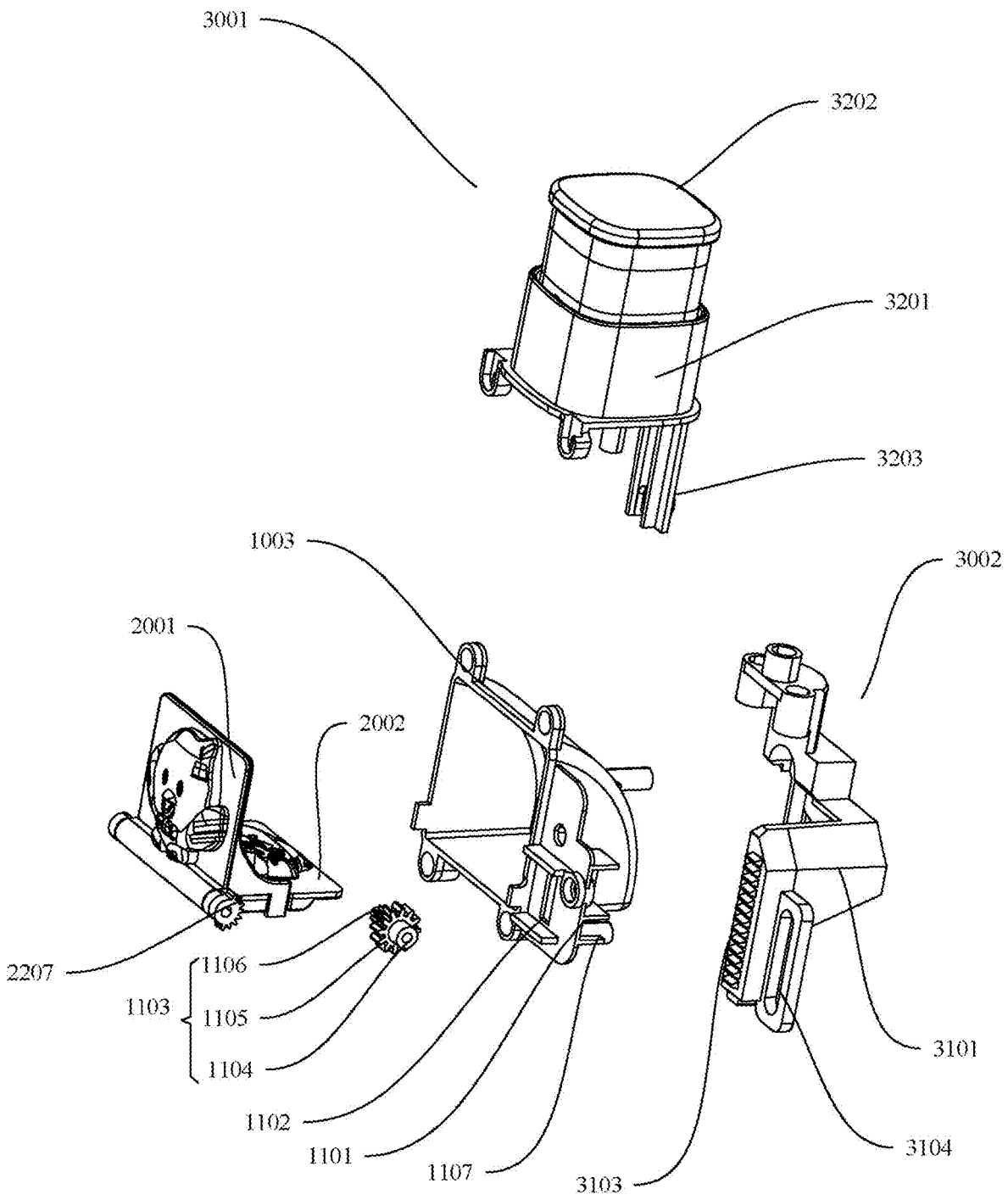
FIG. 6 is a schematic diagram of a transmission connecting structure of a scene switching device and a scene decoration device.

In this embodiment, as shown in FIGS. 5-6, a first installation slot 1005 is defined in the toy main body 1000, and the scene switching device 3000 is arranged in the first installation slot 1005. The scene switching device 3000 includes a triggering member 3001, and a transmission device 3002 connected to the triggering member 3001 for transmission. The transmission device 3002 is connected to the scene decoration device 2000 for transmission, so that a user can drive the transmission device 3002 by operating the triggering member 3001, so as to move the scene decoration device 2000 between the first position and the second position. The movement of the scene decoration device is achieved through the transmission device 3002, ensuring smooth switching of the first scene decoration 2001 and the second scene decoration 2002 between the first position and the second position, reducing shaking, and improving the stability and reliability of operation. Moreover, the user can switch scenes by very easy operation of the triggering member 3001, effectively improving the ease of use of the device and allowing users of all ages to easily operate.

In this embodiment, the transmission device 3002 includes a first transmission baffle 3101. The triggering member 3001 includes an outer shell 3201 and a pressing block 3202 slidably disposed within the outer shell 3201. A first end of the outer shell 3201 is fixedly mounted on an outer side wall of the installation outer shell 1003, and a second end of the outer shell 3201 extends downward to form a first sliding block 3203. The first sliding block 3203 is slidably connected to the first transmission baffle 3101. Specifically, a first connecting shaft 3204 is connected to the pressing block 3202. The first connecting shaft 3204 is inserted into the outer shell 3201 and extends downward to connect with the first transmission baffle 3101 for transmission. A first sliding slot 3102 is defined in one side of the first transmission baffle 3101. A position limiting member 1006 is arranged on a rear side wall of the installation outer shell 1003. A position limiting block 3205 is arranged on the first sliding block 3203. An engaging opening 3206 is defined in the position limiting block 3205. The position limiting member 1006 is slidably disposed within the first sliding slot 3102 and extends outward to engage with the engaging opening 3206, so that the first sliding block 3203 is slidably connected to the first transmission baffle 3101. The sliding connection between the first sliding block 3203 and the first transmission baffle 3101 ensures that the transmission device 3002 remains stable during operation, reducing shaking and unnecessary movement, and enhancing the stability of the overall structure. Moreover, the position limiting member 1006 and the position limiting block 3205 effectively prevent misoperation of the first sliding block 3203 and the first transmission baffle 3101. The engaging design of the position limiting block 3205 and the engaging opening 3206 ensures accurate connection between parts and reduces the possibility of misoperation.

In this embodiment, a gear portion 3103 is provided on one side of the first transmission baffle 3101, and a second sliding slot 3104 is also defined adjacent to the gear portion 3103. A second transmission baffle 1101 is provided on a side wall of the installation outer shell 1003, and an opening 1102 is defined in the second transmission baffle 1101. A transmission gear 1103 is installed in the opening 1102. The transmission gear 1103 includes a transmission shaft 1104, a first gear 1105, and a second gear 1106. The first gear 1105 and the second gear 1106 are connected to the transmission shaft 1104. The first gear 1105 is at least partially inserted into the opening 1102 and meshes with the transmission gear 1103. The second transmission baffle 1101 is also provided with a second sliding block 1107. The second sliding block 1107 is slidable in the second sliding slot 3104. The gear portion 3103 in this embodiment meshes with the transmission gear 1103, achieving efficient power transmission and reducing energy loss. Moreover, the second sliding block 1107 slides within the second sliding slot 3104, further enhancing the stability of the system and reducing shaking and unnecessary friction during movement.

In this embodiment, one end of the second connecting plate 2201 is provided with a third gear 2207. The third gear 2207 meshes with the second gear 1106. When the triggering member 3001 is in a triggered state, the first connecting shaft 3204 pushes the first transmission baffle 3101 downward, the engaging opening 3206 separates from the position limiting member 1006, the first sliding block 3203 slides downward in the first sliding slot 3102, and the second sliding block 1107 slides downward in the second sliding slot 3104, so that the gear portion 3103 moves downward to drive the first gear 1105 to rotate. Moreover, the first gear 1105 drives the second gear to rotate to drive the third gear 2207 to rotate, so that the scene decoration device 2000 moves and switches between the first scene decoration 2001 and the second scene decoration 2002. The first gear 1105 drives the second gear and the third gear 2207 to rotate synchronously, so that the smooth switching of the scene decoration device 2000 is achieved, making the toy 100 not only have a smooth scene switching experience, but also improve the overall operational performance of the toy.

Furthermore, the triggering member 3001 is also provided with a restoration member 3207 for restoring the pressing block 3202. When the triggering member 3001 is in an initial state, the first connecting shaft 3204 moves upward under action of the restoration member 3207, the first sliding block 3203 slides upward in the first sliding slot 3102, and the second sliding block 1107 slides upward in the second sliding slot 3104, so that the gear portion 3103 moves upward to drive the first gear 1105, the second gear 1106, and the third gear 2207 to rotate. Moreover, the engaging opening 3206 is engaged with the position limiting member 1006, so that the scene decoration device 2000 switches from the second scene decoration 2002 to the first scene decoration 2001. By arranging the restoration member 3207, the user no longer needs to manually restore the device, which increases the convenience and comfort of use. Moreover, the engaging design of the engaging opening 3206 and the position limiting member 1006 ensures that connecting parts are in the correct position after restoration, effectively preventing misoperation. The user does not need to worry about errors and malfunctions caused by improper operation during operation, which increases the safety and reliability of the device.

Figure 7:
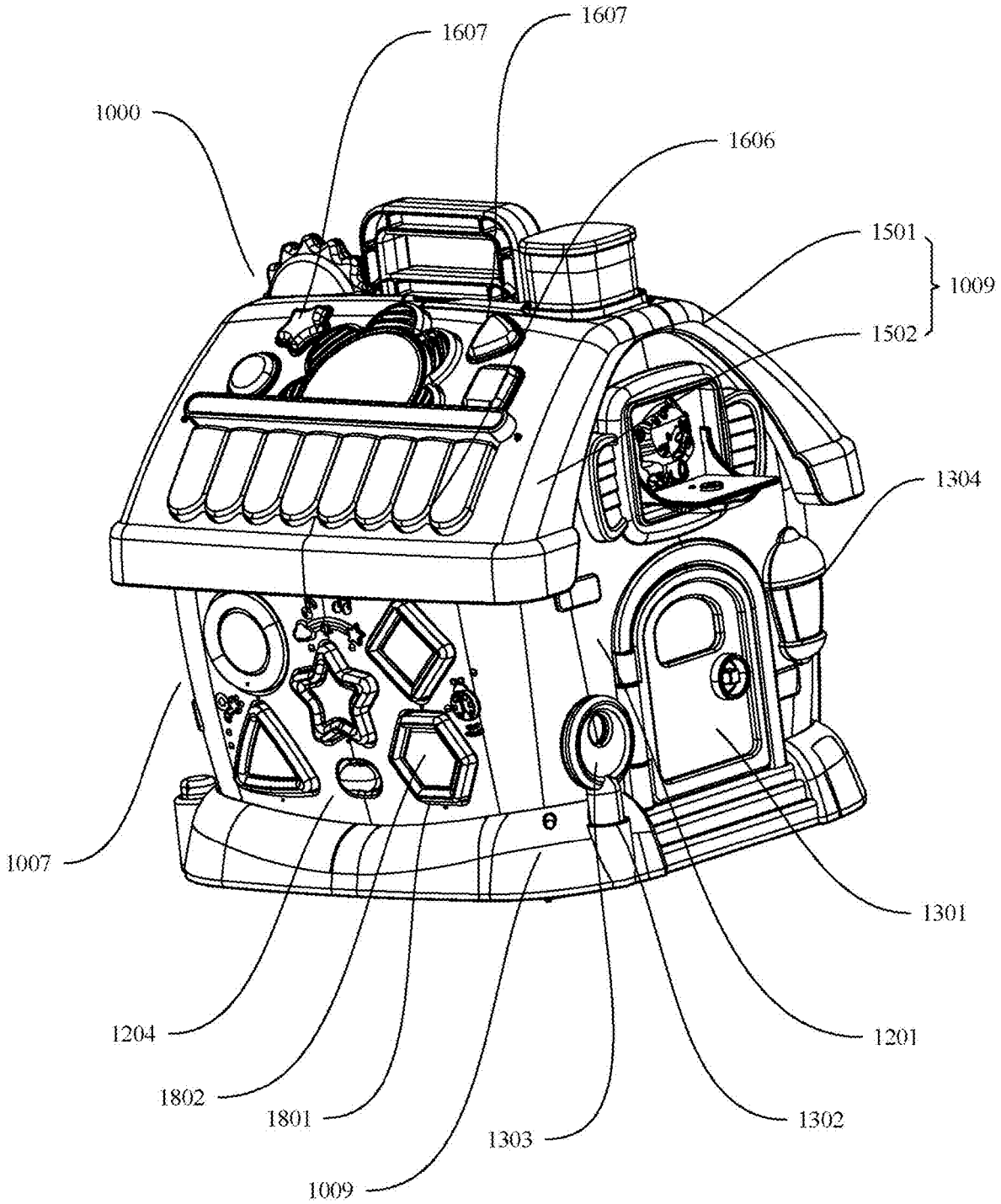
FIG. 7 is a schematic diagram of a structure of a front side wall of a toy main body.

In this embodiment, as shown in FIG. 7, the toy main body 1000 includes a wall 1007, a base 1008, and a roof 1009. The wall 1007 is equipped with a front side wall 1201, a rear side wall 1202, a left side wall 1203, and a right side wall 1204. The front side wall 1201, the rear side wall 1202, the left side wall 1203, and the right side wall 1204 are sequentially connected to surround and form an internal accommodating space.

In this embodiment, as shown in FIG. 7, a first door 1301 is hinged on the front side wall 1201, and an insertion hole 1302 is defined in the base 1008. A key 1303 for opening the first door 1301 is inserted into the insertion hole 1302. A doorbell device 1304 is also provided on the front side wall 1201, and a first light emitting device is provided in the doorbell device 1304. When the first door 1301 is opened, the doorbell device 1304 and the first light emitting device are in a working state. When the first door 1301 is closed, the doorbell device 1304 and the first light emitting device are in a closed state. By providing the key 1303 for unlocking and the doorbell device 1304, the user can easily control opening and closing states of the door, while receiving reminders from the doorbell and lights, improving the overall user experience and convenience of use.

Figure 8:
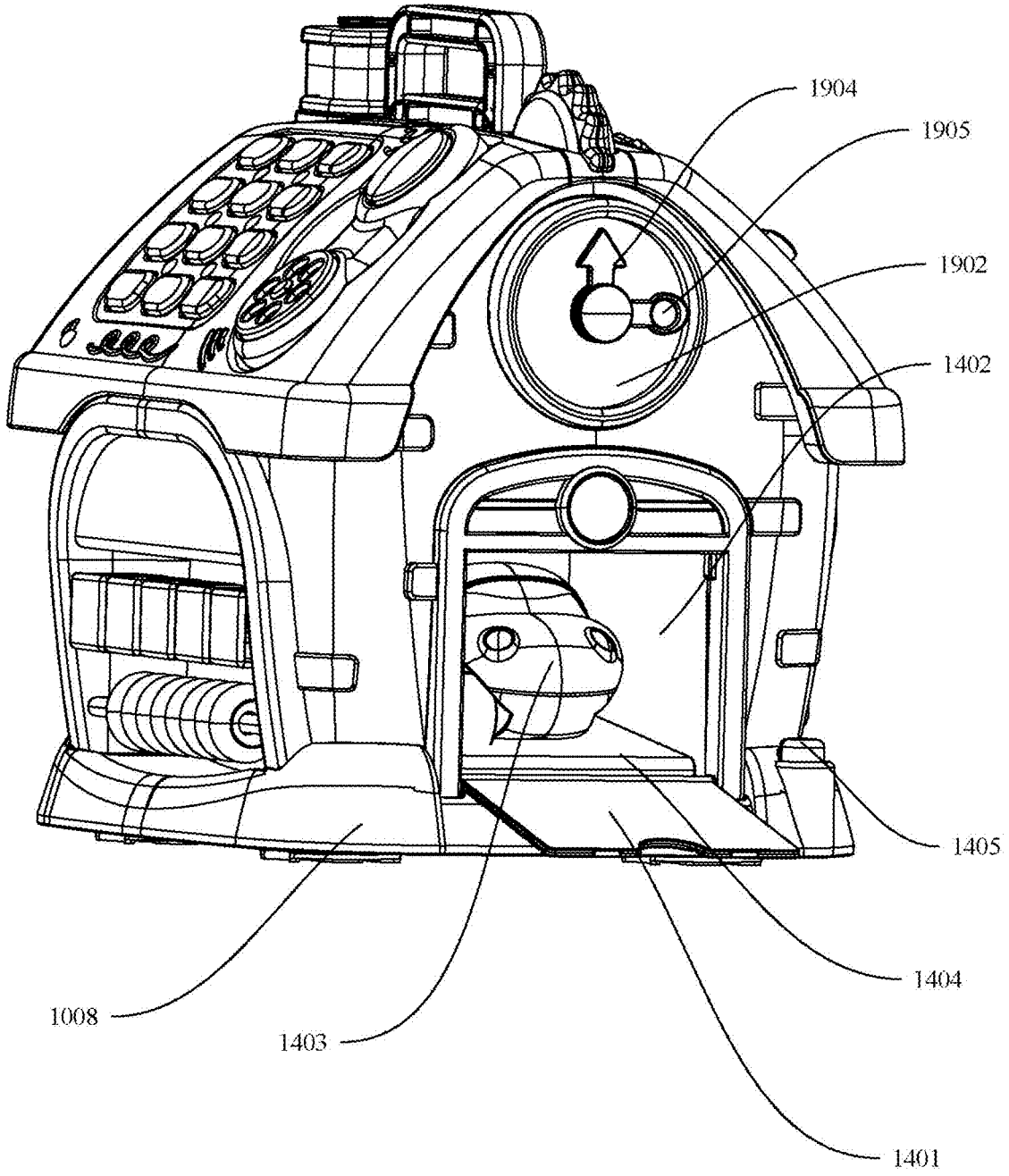
FIG. 8 is a schematic diagram of a structure of a garage on a toy main body.

In this embodiment, as shown in FIG. 8, a second door 1401 is rotatably provided on the base 1008. The second door 1401 and the internal accommodating space form a garage 1402. The garage 1402 is internally equipped with a toy car 1403. A bottom portion of the garage 1402 is equipped with an ejection plate 1404, and the ejection plate 1404 is movably connected to an inner wall of the garage 1402. The base 1008 is also equipped with a garage button 1405. The garage button 1405 is used for driving the ejection plate 1404 to rotate to an ejection position, so that the toy car 1403 is ejected from the garage 1402. By arranging the rotatable second door 1401 and ejection plate 1404 on the base 1008, children can easily operate by pressing the garage button 1405 to eject the toy car 1403 from the garage 1402. This design greatly enhances the interactivity and fun of the toy, providing children with more fun to play.

Figure 9:
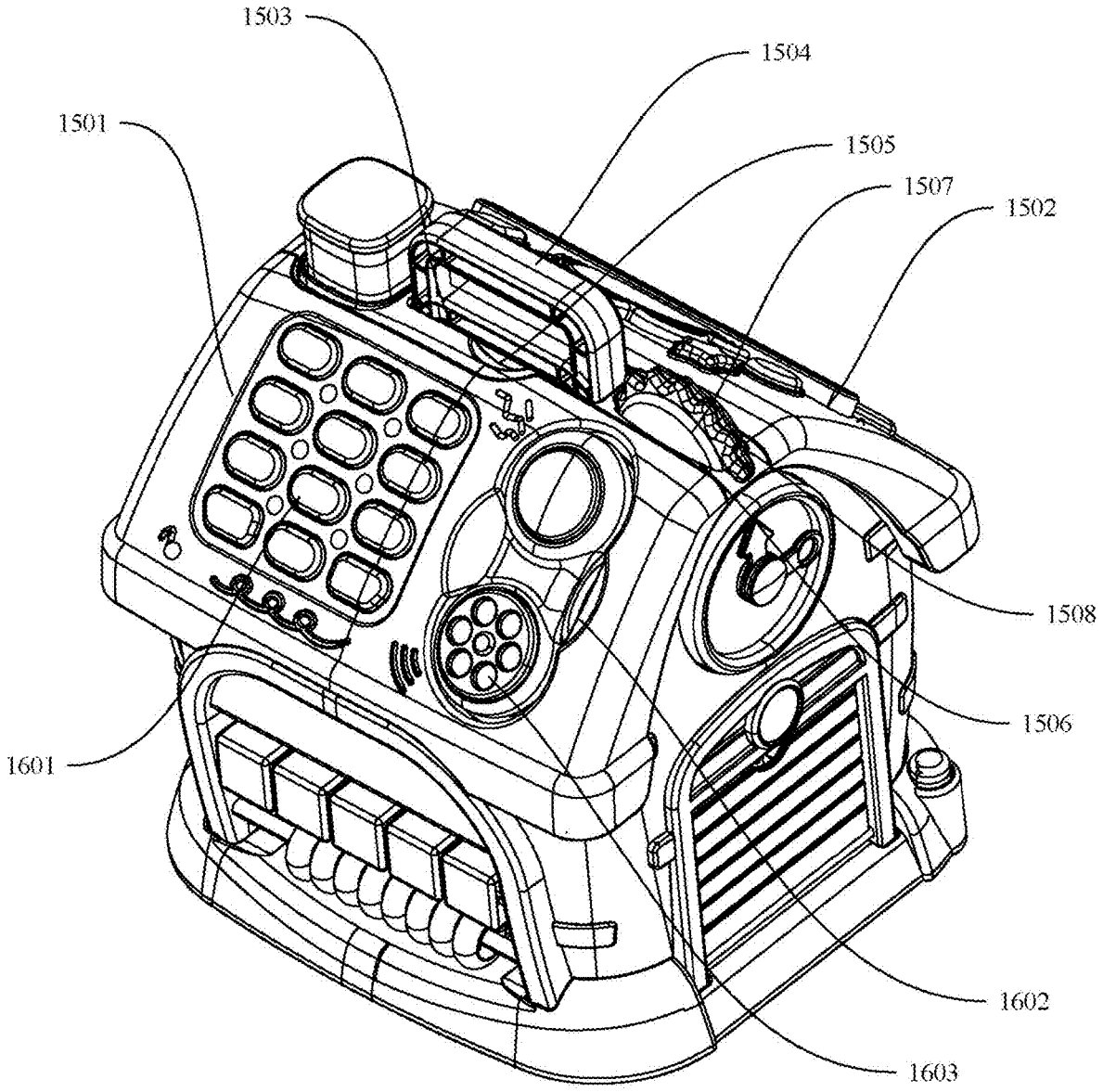
FIG. 9 is a schematic diagram of a structure of a roof.

In this embodiment, as shown in FIG. 9, the roof 1009 includes a first ceiling 1501 and a second ceiling 1502. A first accommodating slot 1503 is defined between the first ceiling 1501 and the second ceiling 1502. A handle 1504 is slidably provided in the first accommodating slot 1503. The handle 1504 is capable of sliding upward or moving downward in the first accommodating slot 1503, so that the handle 1504 has an unfolded state or a stored state. An avoidance slot 1505 is also defined in an upper edge of the first accommodating slot 1503. The avoidance slot 1505 is used for the user to pull the handle 1504 upward out of the first accommodating slot 1503. A second installation slot 1506 is also defined between the first ceiling 1501 and the second ceiling 1502. A display lamp 1507 is provided in the second installation slot 1506. The display lamp 1507 has an arc-shaped structure, and an edge of the display lamp 1507 is provided with a plurality of continuous arc-shaped blocks 1508. By arranging the handle 1504 in the first accommodating slot 1503 and enabling the handle 1504 to slide upward or move downward, the function of unfolding and storing of the handle is provided. The user can easily pull out the handle 1504 from the accommodating slot, making it convenient to carry the toy and increasing the portability of the device. The handle 1504 can be stored in the first accommodating slot 1503 when not in use, without occupying external space. The avoidance slot 1505 further facilitates the pulling out and storage of the handle, improving space utilization efficiency and making the appearance of the toy more neat. In addition, the display lamp 1507 is provided with the arc-shaped structure and the plurality of continuous arc-shaped blocks 1508, making a lighting display effect softer and more beautiful, increasing the visual appeal of the toy, and improving the aesthetics of the toy's appearance.

Figure 10:
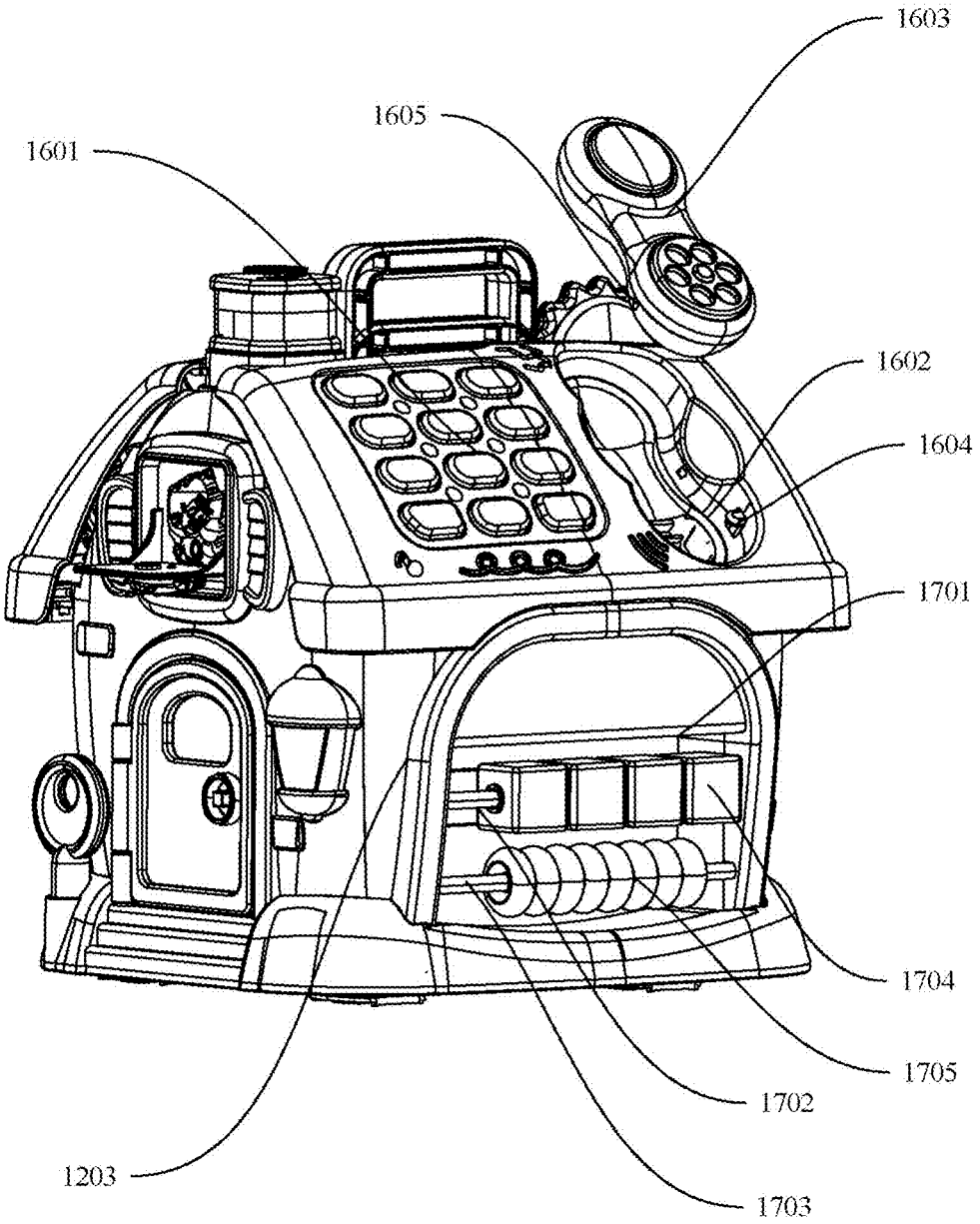
FIG. 10 is a schematic diagram of a structure of a left side wall of a toy main body.

In this embodiment, as shown in FIGS. 9-10, telephone buttons 1601 are provided on the first ceiling 1501. The first ceiling 1501 is provided with a second accommodating slot 1602 adjacent to the telephone button 1601. An earpiece 1603 is provided in the second accommodating slot 1602, and an elastic buckle 1604 is provided on a side wall of the second accommodating slot 1602. A buckle hole 1605 is defined in a side wall of the earpiece 1603, and the elastic buckle 1604 cooperates with the buckle hole 1605 to install the earpiece 1603 in the second accommodating slot 1602. The second ceiling 1502 is provided with a plurality of tone buttons 1606 and a plurality of music playing buttons 1607. The telephone button 1601, the tone button 1606, and the music playing button 1607 are all electrically connected to the sound device to enable the toy 100 to emit sound. By arranging the telephone button 1601 and the second accommodating slot 1602 on the first ceiling 1501, and arranging the earpiece 1603 in the second accommodating slot 1602, children can simulate calls through the buttons and the earpiece, increasing the interactivity and fun of the toy. Moreover, the elastic buckle 1604 on the side wall of the second accommodating slot 1602 and the buckle hole 1605 on the side wall of the earpiece 1603 are used in conjunction, allowing the earpiece to be securely installed in the accommodating slot and easily removed and placed. The operation is simple, and the convenience of use is improved. In addition, the second ceiling 1502 is equipped with the plurality of tone buttons 1606 and the plurality of music playing buttons 1607, further enriching the functionality of the toy. Children can adjust the tone and play music through buttons, increasing the entertainment function and educational value of the toy.

In this embodiment, as shown in FIG. 10, a groove 1701 is defined in the left side wall 1203. The groove 1701 is provided with a first cross bar 1702 and a second cross bar 1703 positioned below the first cross bar 1702. A plurality of pattern blocks 1704 are rotatably provided on the first cross bar 1702, and a plurality of calculation beads 1705 are also rotatably provided on the second cross bar 1703. By arranging the rotatable pattern blocks 1704 and the rotatable calculation beads 1705, the interactivity of the toy has been increased. Children can rotate the pattern blocks and move the calculation beads to engage in various games and operations, enhancing the fun and attractiveness of the toy.

In this embodiment, as shown in FIG. 7, a plurality of first installation holes 1801 are defined in the right side wall 1204. The plurality of first installation holes 1801 have different shapes and structures. A letter button 1802 is correspondingly arranged in the first installation hole 1801, and a light device is arranged in the letter button 1802. When the letter button 1802 is pressed, the letter button 1802 is capable of emitting light. The sound device is provided with a first mode and a second mode. The letter button 1802 is used for switching the sound device between the first mode and the second mode. When the letter button 1802 switches the sound device to the first mode, the sound device emits a pronunciation of a letter. When the letter button 1802 switches the sound device to the second mode, the sound device emits a pronunciation of a shape. The letter button 1802 is equipped with the light device and sound device, which can help children learn letters and shapes through light emitting and pronunciation. When the button switches to the first mode, the sound device emits the pronunciation of the letter. When switching to the second mode, the pronunciation of the shape is emitted, so that children can easily choose to learn letters or shapes. Mode switching can be completed through simple operations, which improves the operation convenience and user friendliness of the toy.

Figure 11:
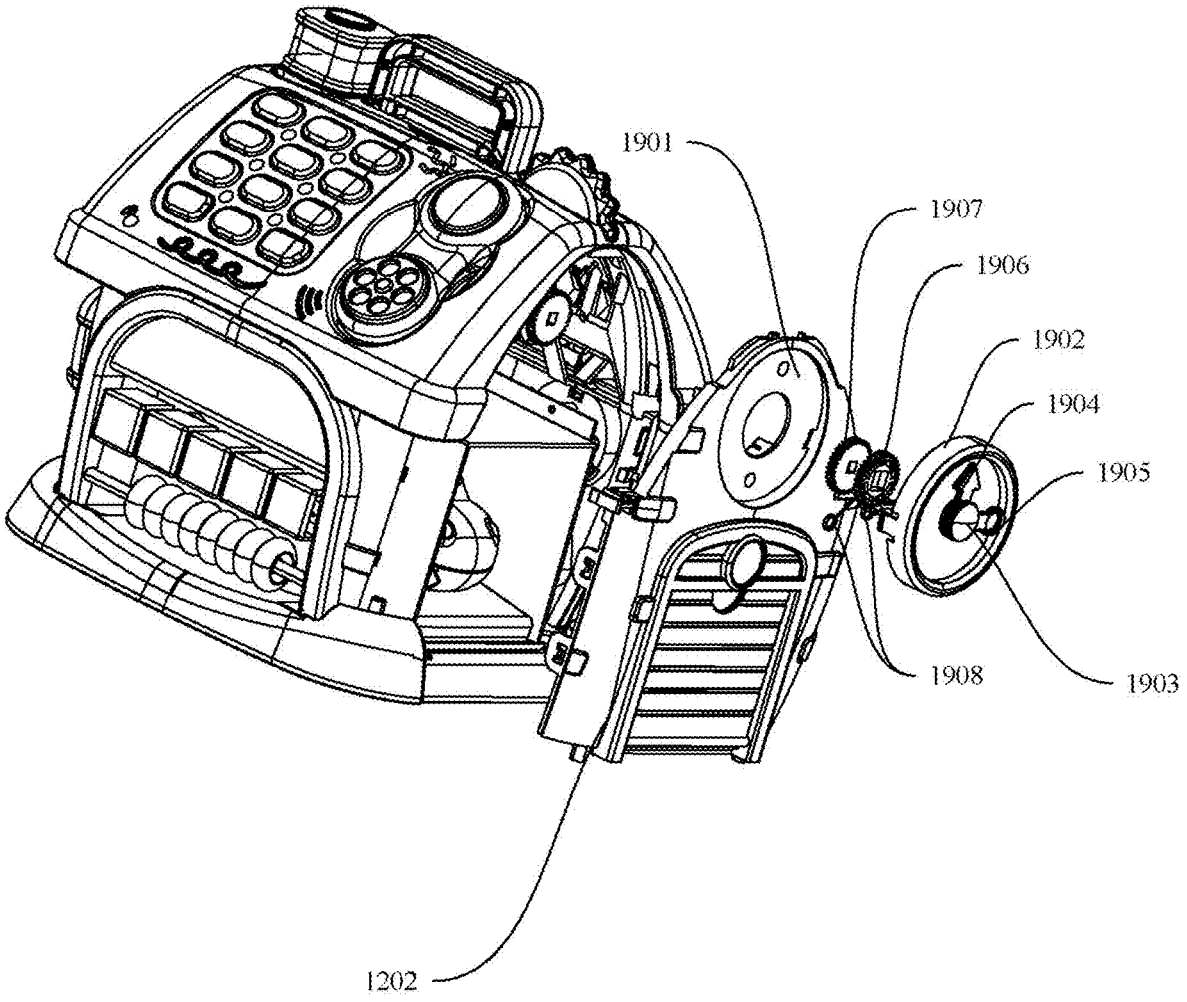
FIG. 11 is a schematic diagram of a clock device on a rear side wall of a toy main body.

In this embodiment, as shown in FIG. 11, a second installation hole 1901 is defined in the rear side wall 1202, and a clock device 1902 is installed in the second installation hole 1901. The clock device 1902 includes a second connecting shaft 1903, an hour hand 1904, and a minute hand 1905. The hour hand 1904 and the minute hand 1905 are connected to the second connecting shaft 1903. The second connecting shaft 1903 is also provided with a fourth gear 1906 and a fifth gear 1907. At least two elastic sheets 1908 are provided on an inner wall surface of the rear side wall 1202, and the elastic sheets 1908 respectively abut against the fourth gear 1906 and the fifth gear 1907, so that the hour hand 1904 and the minute hand 1905 produce damping sound when rotating.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A multifunctional toy, comprising:

a toy main body, wherein a display window is provided on the toy main body;

a scene decoration device, wherein the scene decoration device is connected to the toy main body, the scene decoration device comprises a first scene decoration and a second scene decoration, and the first scene decoration and the second scene decoration are movable between a first position and a second position; and a scene switching device, wherein the scene switching device is used for driving the scene decoration device to move between the first position and the second position;

wherein when the scene switching device is in an initial state, the scene decoration device is positioned in the first position, and the first scene decoration is capable of being displayed through the display window; when the scene switching device is in a triggered state, the scene decoration device moves and switches to the second position, and the second scene decoration is capable of being displayed through the display window;

wherein the toy main body comprises a wall, a base, and a roof; the wall is equipped with a front side wall, a rear side wall, a left side wall, and a right side wall; and the front side wall, the rear side wall, the left side wall, and the right side wall are sequentially connected to surround and form an internal accommodating space;

wherein a first door is hinged on the front side wall; an insertion hole is defined in the toy main body; a key for opening the first door is inserted into the insertion hole; a doorbell device is also provided on the front side wall; a first light emitting device is provided in the doorbell device; when the first door is opened, the doorbell device and the first light emitting device are in a working state; and when the first door is closed, the doorbell device and the first light emitting device are in a closed state.

2. The multifunctional toy according to claim 1, wherein an accommodating cavity is defined in the toy main body; when the scene switching device is in the initial state, the scene decoration device is positioned in the first position, the first scene decoration is capable of being displayed through the display window, and the second scene decoration is positioned inside the accommodating cavity; when the scene switching device is in the triggered state, the scene decoration device moves and switches to the second position, the second scene decoration is capable of being displayed through the display window, and the first scene decoration is positioned inside the accommodating cavity.

3. The multifunctional toy according to claim 1, wherein the toy main body is internally equipped with a power device and a sound device; and the power device, the sound device, and the scene switching device are electrically connected, so that when the first scene decoration and the second scene decoration move between the first position and the second position, the toy will emit sound.

4. The multifunctional toy according to claim 1, wherein the first scene decoration comprises a first connecting plate and a first decorative pattern; the second scene decoration comprises a second connecting plate and a second decorative pattern; one end of the first connecting plate is connected to one end of the second connecting plate; an opposite end of the first connecting plate extends in a different direction from an opposite end of the second connecting plate; a cavity is surrounded and formed between an inner wall surface of the first connecting plate and an inner surface of the second connecting plate; the first decorative pattern is arranged on an outer wall surface of the first connecting plate; the second decorative pattern is arranged inside the cavity; the second decorative pattern is installed on the inner surface of the second connecting plate; and the first decorative pattern has a different appearance shape from the second decorative pattern.

5. The multifunctional toy according to claim 4, wherein two side walls of the first connecting plate are respectively connected to two side walls of the second connecting plate; an engaging block is provided on a side wall of the first connecting plate; an engaging slot is defined in a side wall of the second connecting plate; and the engaging block is engaged with the engaging slot, so that the first connecting plate is connected to the second connecting plate.

6. The multifunctional toy according to claim 5, wherein the toy main body comprises an installation outer shell; the accommodating cavity is formed by a recess of the installation outer shell; the scene decoration device is rotatably connected inside the installation outer shell; rotation slots are defined in side walls at both ends of the installation outer shell respectively; one end of the first connecting plate is provided with a connecting portion; the connecting portion comprises a first connecting slot and a first connecting blocks; the first connecting blocks are positioned at two ends; a second connecting slot is defined in one end of the second connecting plate; bottom ends of two side walls of the second connecting plate are respectively provided with second connecting blocks; the connecting portion is embedded in the second connecting slot; and the second connecting block is inserted into the rotation slot, so that the scene decoration device is rotatably connected to the installation outer shell.

7. The multifunctional toy according to claim 1, wherein the insertion hole is defined in the base.

8. The multifunctional toy according to claim 1, wherein the roof comprises a first ceiling and a second ceiling; a first accommodating slot is defined between the first ceiling and the second ceiling; a handle is slidably provided in the first accommodating slot; the handle is capable of sliding upward or moving downward in the first accommodating slot, so that the handle has an unfolded state or a stored state; an avoidance slot is also defined in an upper edge of the first accommodating slot; the avoidance slot is used for a user to pull the handle upward out of the first accommodating slot; a second installation slot is also defined between the first ceiling and the second ceiling; a display lamp is provided in the second installation slot; the display lamp has an arc-shaped structure; and an edge of the display lamp is provided with a plurality of continuous arc-shaped blocks.

9. The multifunctional toy according to claim 8, wherein telephone buttons are provided on the first ceiling; the first ceiling is provided with a second accommodating slot adjacent to the telephone button; an earpiece is provided in the second accommodating slot; an elastic buckle is provided on a side wall of the second accommodating slot; a buckle hole is defined in a side wall of the earpiece; the elastic buckle cooperates with the buckle hole to install the earpiece in the second accommodating slot; the second ceiling is provided with a plurality of tone buttons and a plurality of music playing buttons; and the telephone button, the tone button, and the music playing button are all electrically connected to the sound device to enable the toy to emit sound.

10. The multifunctional toy according to claim 1, wherein a groove is defined in the left side wall; the groove is provided with a first cross bar and a second cross bar positioned below the first cross bar; a plurality of pattern blocks are rotatably provided on the first cross bar; and a plurality of calculation beads are also rotatably provided on the second cross bar.

11. The multifunctional toy according to claim 1, wherein a plurality of first installation holes are defined in the right side wall; the plurality of first installation holes have different shapes and structures; a letter button is correspondingly arranged in the first installation hole; a light device is arranged in the letter button; when the letter button is pressed, the letter button is capable of emitting light; the sound device is provided with a first mode and a second mode; the letter button is used for switching the sound device between the first mode and the second mode; when the letter button switches the sound device to the first mode, the sound device emits a pronunciation of a letter; and when the letter button switches the sound device to the second mode, the sound device emits a pronunciation of a shape.

12. The multifunctional toy according to claim 1, wherein a second installation hole is defined in the rear side wall; a clock device is installed in the second installation hole; the clock device comprises a second connecting shaft, an hour hand, and a minute hand; the hour hand and the minute hand are connected to the second connecting shaft; the second connecting shaft is also provided with a fourth gear and a fifth gear; at least two elastic sheets are provided on an inner wall surface of the rear side wall; and the elastic sheets respectively abut against the fourth gear and the fifth gear, so that the hour hand and the minute hand produce damping sound when rotating.

13. A multifunctional toy, comprising:

a toy main body, wherein a display window is provided on the toy main body;

a scene decoration device, wherein the scene decoration device is connected to the toy main body, the scene decoration device comprises a first scene decoration and a second scene decoration, and the first scene decoration and the second scene decoration are movable between a first position and a second position; and a scene switching device, wherein the scene switching device is used for driving the scene decoration device to move between the first position and the second position;

wherein when the scene switching device is in an initial state, the scene decoration device is positioned in the first position, and the first scene decoration is capable of being displayed through the display window; when the scene switching device is in a triggered state, the scene decoration device moves and switches to the second position, and the second scene decoration is capable of being displayed through the display window;

wherein the first scene decoration comprises a first connecting plate; the second scene decoration comprises a second connecting plate; one end of the first connecting plate is connected to one end of the second connecting plate; an opposite end of the first connecting plate extends in a different direction from an opposite end of the second connecting plate; a cavity is surrounded and formed between an inner wall surface of the first connecting plate and an inner surface of the second connecting plate;

wherein two side walls of the first connecting plate are respectively connected to two side walls of the second connecting plate; and the first connecting plate is connected to the second connecting plate;

wherein the toy main body comprises an installation outer shell; the accommodating cavity is formed by a recess of the installation outer shell; the scene decoration device is rotatably connected inside the installation outer shell; rotation slots are defined in side walls at both ends of the installation outer shell respectively; one end of the first connecting plate is provided with a connecting portion; the connecting portion comprises a first connecting slot and a first connecting blocks; the first connecting blocks are positioned at two ends; a second connecting slot is defined in one end of the second connecting plate; bottom ends of two side walls of the second connecting plate are respectively provided with second connecting blocks; the connecting portion is embedded in the second connecting slot; and the second connecting block is inserted into the rotation slot, so that the scene decoration device is rotatably connected to the installation outer shell;

wherein a first installation slot is defined in the toy main body; the scene switching device is arranged in the first installation slot; the scene switching device comprises a triggering member, and a transmission device connected to the triggering member for transmission; and the transmission device is connected to the scene decoration device for transmission, so that a user can drive the transmission device by operating the triggering member, so as to move the scene decoration device between the first position and the second position;

wherein the transmission device comprises a first transmission baffle; the triggering member extends downward to form a first sliding block; and the first sliding block is slidably connected to the first transmission baffle.

14. The multifunctional toy according to claim 13, wherein the triggering member comprises an outer shell and a pressing block slidably disposed within the outer shell; a first end of the outer shell is fixedly mounted on an outer side wall of the installation outer shell; a second end of the outer shell extends downward to form the first sliding block.

15. The multifunctional toy according to claim 14, wherein a first connecting shaft is connected to the pressing block; the first connecting shaft is inserted into the outer shell and extends downward to connect with the first transmission baffle for transmission; a first sliding slot is defined in one side of the first transmission baffle; a position limiting member is arranged on a rear side wall of the installation outer shell; a position limiting block is arranged on the first sliding block; an engaging opening is defined in the position limiting block; and the position limiting member is slidably disposed within the first sliding slot and extends outward to engage with the engaging opening, so that the first sliding block is slidably connected to the first transmission baffle.

16. The multifunctional toy according to claim 15, wherein a gear portion is provided on one side of the first transmission baffle; a second sliding slot is also defined adjacent to the gear portion; a second transmission baffle is provided on a side wall of the installation outer shell; an opening is defined in the second transmission baffle; a transmission gear is installed in the opening; the transmission gear comprises a transmission shaft, a first gear, and a second gear; the first gear and the second gear are connected to the transmission shaft; the first gear is at least partially inserted into the opening and meshes with the transmission gear; the second transmission baffle is also provided with a second sliding block; and the second sliding block is slidable in the second sliding slot.

17. The multifunctional toy according to claim 16, wherein the second connecting block is also provided with a third gear; the third gear meshes with the second gear; when the triggering member is in a triggered state, the first connecting shaft pushes the first transmission baffle downward, the engaging opening separates from the position limiting member, the first sliding block slides downward in the first sliding slot, and the second sliding block slides downward in the second sliding slot, so that the gear portion moves downward to drive the first gear to rotate; and the first gear drives the second gear to rotate to drive the third gear to rotate, so that the scene decoration device moves and switches between the first scene decoration and the second scene decoration.

18. The multifunctional toy according to claim 16, wherein the triggering member is also provided with a restoration member for restoring the pressing block; when the triggering member is in an initial state, the first connecting shaft moves upward under action of the restoration member, the first sliding block slides upward in the first sliding slot, and the second sliding block slides upward in the second sliding slot, so that the gear portion moves upward to drive the first gear, the second gear, and the third gear to rotate; and the engaging opening is engaged with the position limiting member, so that the scene decoration device switches from the second scene decoration to the first scene decoration.

19. A multifunctional toy, comprising:

a toy main body, wherein a display window is provided on the toy main body;

a scene decoration device, wherein the scene decoration device is connected to the toy main body, the scene decoration device comprises a first scene decoration and a second scene decoration, and the first scene decoration and the second scene decoration are movable between a first position and a second position; and a scene switching device, wherein the scene switching device is used for driving the scene decoration device to move between the first position and the second position;

wherein when the scene switching device is in an initial state, the scene decoration device is positioned in the first position, and the first scene decoration is capable of being displayed through the display window; when the scene switching device is in a triggered state, the scene decoration device moves and switches to the second position, and the second scene decoration is capable of being displayed through the display window;

wherein the toy main body comprises a wall, a base, and a roof; the wall is equipped with a front side wall, a rear side wall, a left side wall, and a right side wall; and the front side wall, the rear side wall, the left side wall, and the right side wall are sequentially connected to surround and form an internal accommodating space;

wherein a second door is rotatably provided on the base; the second door and the internal accommodating space form a garage; the garage is internally equipped with a toy car; a bottom portion of the garage is equipped with an ejection plate; the ejection plate is movably connected to an inner wall of the garage; the base is also equipped with a garage button; and the garage button is used for driving the ejection plate to rotate to an ejection position, so that the toy car is ejected from the garage.

* * * * *